US005699964A

United States Patent [19]

Bergmann et al.

[11] Patent Number: 5,699,964

[45] Date of Patent: Dec. 23, 1997

[54] SHOWERHEAD AND BOTTOM PORTION THEREOF

[75] Inventors: Konrad Bergmann, Schweich, Germany; Claudio Fait, Mailand, Italy; Klaus-Jürgen Läller, Meckenheim, Germany

[73] Assignee: Ideal-Standard GmbH, Bonn, Germany

[21] Appl. No.: 700,566

[22] Filed: Aug. 13, 1996

Related U.S. Application Data

[63] Continuation of PCT/EP95/00585, Feb. 17, 1995.

[51] Int. Cl.[6] ..... B05B 1/00; B05B 15/00; B05B 15/02

[52] U.S. Cl. ..... 239/106; 239/546; 239/602

[58] Field of Search ..... 601/169; 4/606; 401/28, 273; 239/104, 106, 114, 115, 116, 117, 123, 380, 381, 546, 602

[56] References Cited

U.S. PATENT DOCUMENTS

| | | | |
|---|---|---|---|
| 2,402,741 | 10/1946 | Draviner | 239/602 X |
| 4,467,964 | 8/1984 | Kaeser | 239/312 |
| 5,172,862 | 12/1992 | Heimann et al. | 239/114 |
| 5,228,625 | 7/1993 | Grassberger | 239/602 X |
| 5,405,089 | 4/1995 | Heimann et al. | 239/602 X |

FOREIGN PATENT DOCUMENTS

| | | | |
|---|---|---|---|
| 443538 | 2/1991 | European Pat. Off. . | |
| 435031 | 7/1991 | European Pat. Off. | 239/115 |
| 3704782 | 9/1988 | Germany | 239/602 |

*Primary Examiner*—Andres Kashnikow
*Assistant Examiner*—Robin O. Evans
*Attorney, Agent, or Firm*—Sixbey, Friedman, Leedom & Ferguson; David S. Safran

[57] ABSTRACT

The showerhead of the present invention permits the removal of damaging water deposits, such as lime deposits, without causing damage to the surrounding showerhead portion on which the deposits are located. The showerhead includes a bottom portion with resilient extended portions associated with water exit ports of the showerhead wherein said resilient portions can be manipulated for removal of lime deposits from water. Specifically, the bottom portion of the showerhead may include a projection member extending along the periphery of the showerhead. The bottom portion may also comprise a membrane member including a plurality of water passage openings therethrough.

37 Claims, 13 Drawing Sheets

FIG. 4
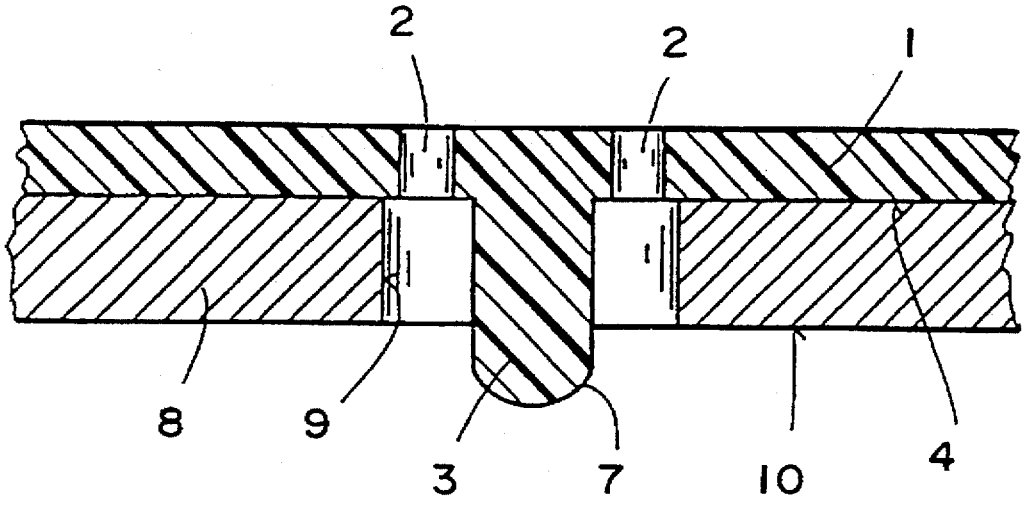
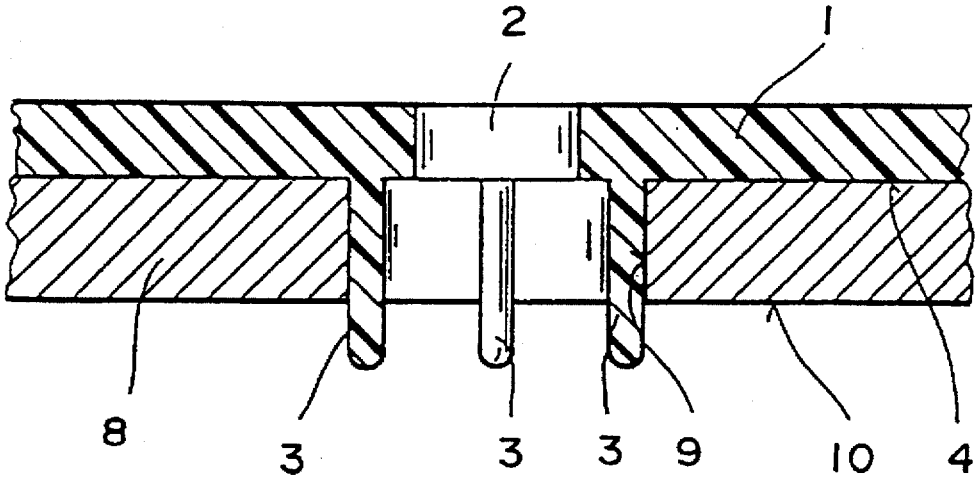
FIG. 5

FIG. 6
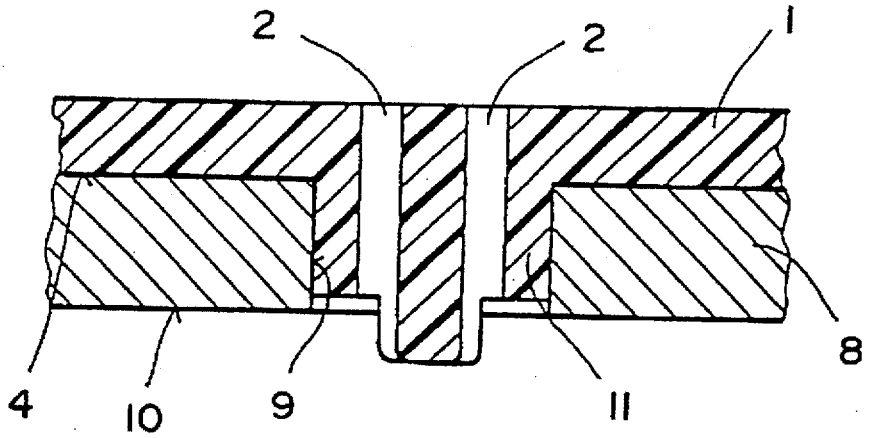
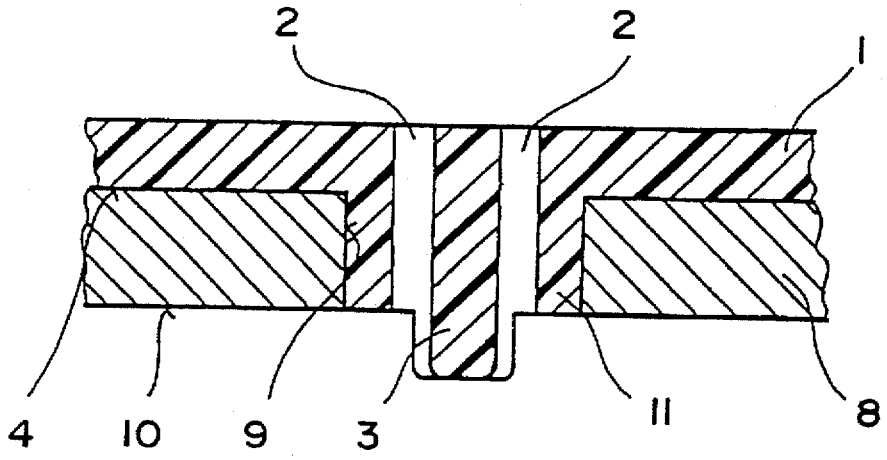
FIG. 7
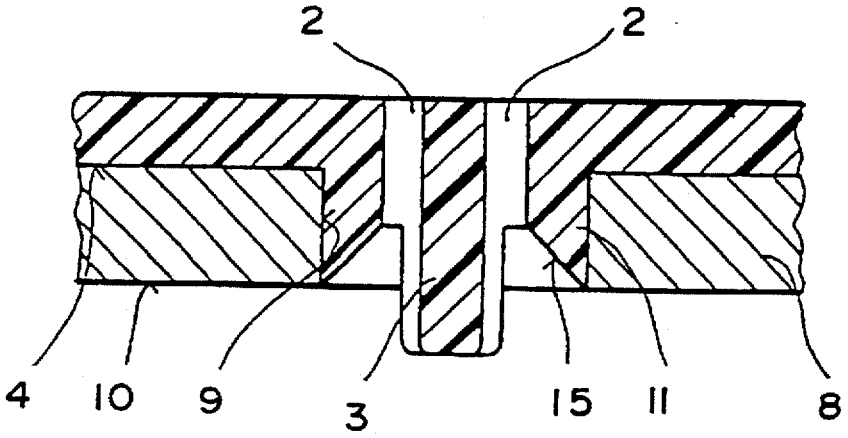
FIG. 8

FIG. 12
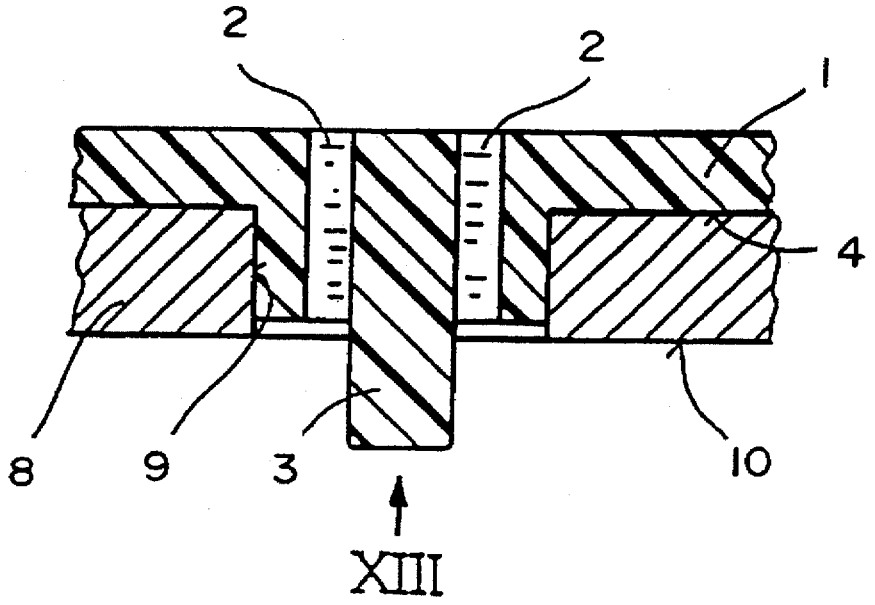
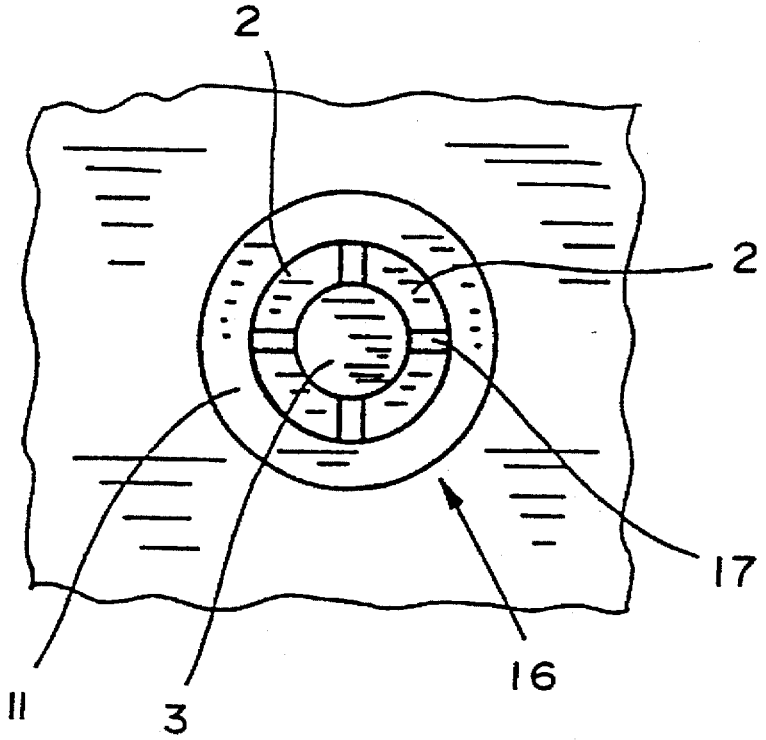
FIG. 13

SHOWERHEAD AND BOTTOM PORTION THEREOF

This is a continuation of pending international Application No. PCT/EP 95/00585 filed on Feb. 17, 1995, designating the United States.

BACKGROUND OF THE INVENTION

Showerheads and particularly bottom portions of showerheads have been designed to deal with problems resulting from water deposits, namely hard water deposits. U.S. Pat. No. 4,467,964 discloses a bottom portion of the initially mentioned type. In this known bottom portion, when the showerhead is being used, especially when hard to very hard tap water is being used, the problem of lime deposits arises which precipitates in the showerhead quickly. The lime deposits clog the water exit openings and greatly impede the operation of the bottom portion of the showerhead.

In order to eliminate the lime deposits which are inherently unavoidable, various proposals have already been made. A showerhead of the initially mentioned type is already known from EP-A-0 443 538, in which there are pegs molded onto the bottom portion through which the water passage openings are routed and which project beyond the bottom of the showerhead. By manual "rubbing" over the elastically deformable ends of the pegs it is possible to remove the time encrustations.

The showerhead known from EP-A-0 435 031 is based on a similar principle; on its bottom portion are hose-like exit openings made of a material with a hardness of 20 to 100 shore. Manual rubbing on the tube-like exit openings is designed to detach the lime which has been deposited in the openings.

Both in EP-A-0 443 538 and also in EP-A-0 435 031 therefore do the water passage openings project beyond the peg-like or hose-like extensions over the bottom of the showerhead. The problem in the known peg-like or hose-like extensions is created during manual rubbing, particularly since the walls of the extensions are thin, and, thus, crimping, edge tearing or complete tearing of the extensions can occur. In this way not only can the function of the showerhead, but also the possibility of eliminating lime deposits be greatly hindered.

U.S. Pat. No. 2,402,741 discloses a showerhead including an elastic bottom portion material. In this showerhead, among others, to prevent deposits or for self-cleaning, the bottom portion consists of elastic material. This results in the fact that the size of the water passage openings charges depending on the water pressure. In this way, however, effective prevention of lime deposits or clogging of the water passage openings is not ensured, since the clogging lime particles are not removed in the case of more severe clogging of the water passage openings especially with larger lime particles since only slight expansion of the exit cross section of the water passage openings occurs.

SUMMARY OF THE INVENTION

It is an object of the present invention to overcome the shortcomings of the art cited above by providing a showerhead and bottom portion thereof which permits the easy removal of water deposits therefrom.

Another object of the present invention is to provide a showerhead and bottom portion thereof which permits removal of water deposits without damaging the structure of the showerhead and bottom portion thereof.

Yet another object of the present invention is to provide a bottom portion of a showerhead with resilient extended portions associated with water exit ports of the showerhead wherein said resilient portions can be manipulated for removal of lime deposits from the water passages.

Still another object of the present invention is to provide a bottom portion of a showerhead comprising an annular projection including water passage openings therein, the projection being shaped to strengthen the water passage such that damage does not occur during manipulation of the bottom portion to remove lime deposits therefrom.

Another object of the present invention is to provide a bottom portion of a showerhead comprising at least one section which has at least one water passage opening which is accessible from the bottom of the showerhead and made of a membrane.

These as well as additional objects of the present invention are achieved by providing a showerhead including a bottom portion wherein a projection thereof is assigned directly to at least one water passage opening such that the outer surface of the projection passes continuously into the inner surface of the water discharge opening. Direct assignment of a projection to at least one water passage opening results in elastic deformation in the area of the projection and thus in the area of the assigned water passage opening(s) due to the elasticity of the bottom portion when the projection moves back and forth; this leads directly to detachment of the lime deposits.

Specifically, the bottom portion may have a somewhat annular projection which projects beyond the bottom of the showerhead. Water passage openings are distributed over the length of the projection. In the invention therefore, as in the past, the possibility of manual "rubbing" is used to eliminate lime deposits in the water passage openings. However, in the showerhead according to the present invention with a projection member which has at least one ring segment, preferably however the shape of a closed ring, there is no longer the danger of damage which exists in the aforementioned extension. By means of the shape of the peripheral projection member the water passage openings are strengthened such that the danger of damage to the bottom portion during "rubbing" no longer exists. Since the projection member consists of the same elastic material as the bottom portion, the annular projection member can be easily elastically deformed by manual "rubbing", by which the lime particles in the water passage openings are detached and then fall out or are washed out of them.

Further, the bottom portion of the showerhead may include at least one section which has at least one water passage opening, which is accessible from the bottom of the showerhead and which is made as a membrane. Lime deposits can be easily removed from the corresponding water passage openings by the formation of the section as a membrane according to the invention. This can take place on the one hand by rubbing gently for example with the fingers or fingertips over the section and exerting a slight pressure on the sections or the membrane so that based on the elasticity of the material of the bottom portion and especially the elasticity of the membrane it is pressed into the showerhead; this leads to deformation of the section and the water passage opening(s) located therein and thus to detachment of the lime deposits. On the other hand, during operation of the showerhead according to the invention, automatic self-cleaning arises, since any change of the water pressure leads to movement of the section made as a membrane and thus to lime detachment. No damage to the bottom portion need be feared in this embodiment either during cleaning of the water passage openings and with the associated adverse affect on the shower function of the showerhead.

Other features, advantages and possible applications of this invention arise from the subclaims, the following description of embodiments using the drawing, and the drawing itself.

BRIEF DESCRIPTION OF THE DRAWINGS

FIGS. 6 through 9 show cross sectional views of different embodiments of this invention, FIG. 12 shows a cross sectional view of another embodiment of this invention, FIG. 13 shows a view in the direction of arrow XIII from FIG. 12.

DETAIL DESCRIPTION OF THE INVENTION

Figure 1:
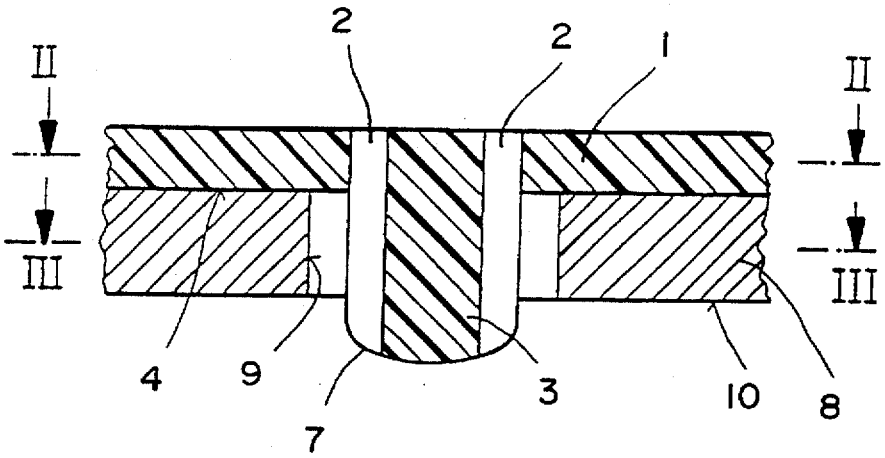
FIG. 1 shows a cross sectional view of one portion of a showerhead according to the invention with a bottom portion according to this invention.

FIGS. 1 through 13 each show only one portion of a showerhead which is not detailed. Since the water supply and the formation of the showerhead are known in and of themselves except for the bottom portion with carrier portion described below, a detailed explanation for this embodiment is omitted. Reference is made expressly to the initially named prior art with respect to the structure of the showerhead itself.

The showerhead of the present invention permits the removal of damaging water deposits, such as lime deposits, without causing damage to the surrounding showerhead portion on which the deposits lie. Specifically, with reference to FIG. 1, the showerhead includes a bottom portion 1. Bottom portion 1 is provided with a plurality of water passage openings 2. Bottom portion 1 itself consists of an elastic material, preferably with a hardness of 20 to 120 shore.

It is significant that there is at least one projection 3 located adjacent to at least one water passage opening 2. This projection 3 is joined to bottom portion 1 and passes beyond external side 4 of bottom portion 1. For the sake of clarification, projection 3 itself has no water passage opening. In any case, projection 3 which projects beyond external side 4 of bottom portion 1 enables removal of lime deposits from water passage openings 2. By moving projection 3, which can be done for example by manual rubbing, elastic bottom portion 1 is deformed; this can lead to a change in the cross section of water passage openings 2. In this way lime particles which have been deposited in water passage openings 2 can be especially easily removed from the wall of water passage openings 2 and bottom portion 1 without the danger of damage to projection 3 or water passage openings 2.

For engineering reasons, it is preferable to make projection 3 integral with bottom portion 1 so that projection 3 is made from the same elastic material as bottom portion 1. Making projection 3 out of flexible material is incidentally also very user-friendly. Of course, the bottom portion and the projection could also consist of different materials.

Projection 3 can basically have a knob-like or rib-like shape with circular or oval cross section. Of course, other cross sectional shapes of the projection are possible. In any case projection 3 should be positioned directly adjacent to at least one water passage opening 2. Direct positioning of one projection 3 to one water passage opening 2 causes elastic deformation of bottom portion 1 with even minor movements of projection 3 and thus a change in the cross section of the corresponding water passage opening 2. This leads to outstanding lime removal.

Figure 2:
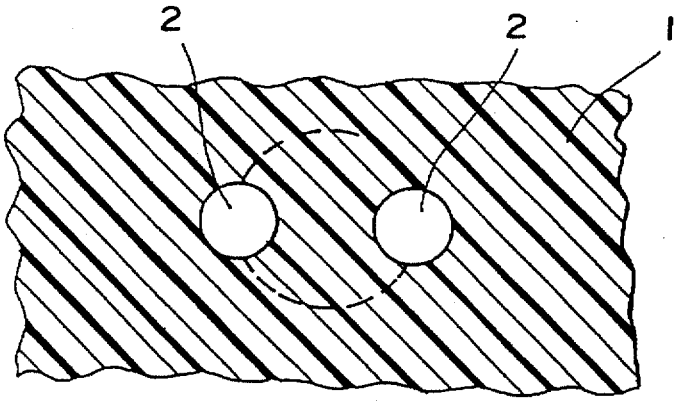
FIG. 2 shows a view along traverse II—II from FIG. 1.
Figure 3:
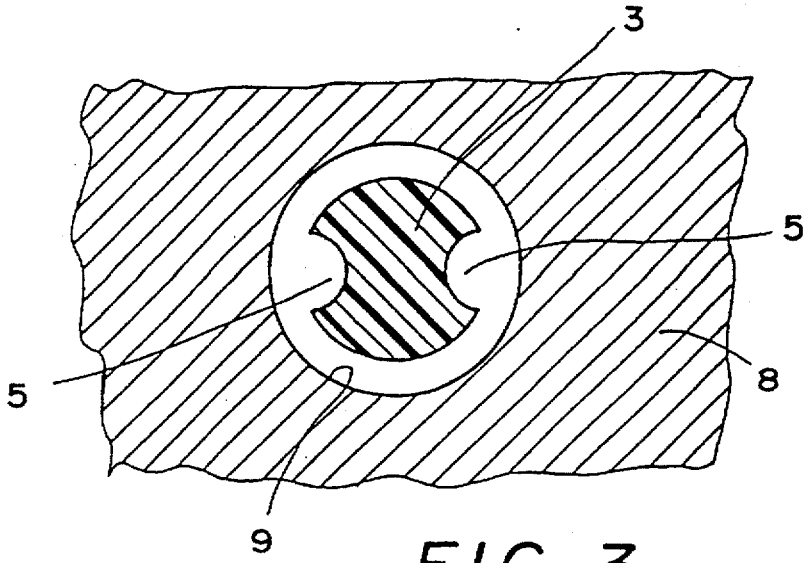
FIG. 3 shows a view along traverse III—III from FIG. 1, FIGS. 4 & 5 are cross-section views corresponding to that of FIG. 1, but showing two modified embodiments of a bottom portion according to the present invention.
Figure 11:
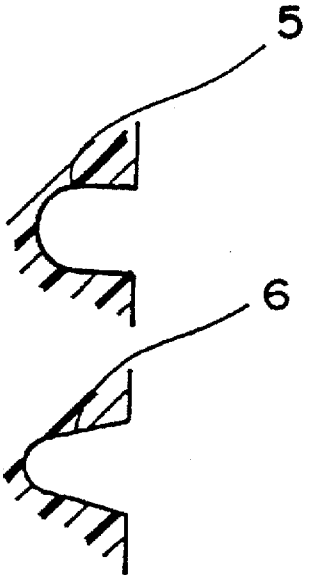
FIG. 11 shows an enlarged representation of section XI from FIG. 10, with two alternatives.

Direct positioning is even further improved by providing in projection 3 at least one recess 5 or notch 6 which preferably passes continuously into water passage opening 2. Reference should be made especially to FIGS. 2, 3, and 11 with respect to recess 5 or notch 6. The continuous transition of recess 5 or notch 6 into water passage opening 2, shown particularly in FIGS. 1 and 6 through 9, at only slight pressure on projection 3 leads to lime detachment, but it also imparts a certain direction to the water jets produced by water passage openings 2. For this reason projection 3 is then sloped in the area of recess 5 or notch 6 against the vertical. This incline against vertical can be recognized for example in the embodiment according to FIG. 9. Further, projection 3 on its outer end may include curvature 7 which produces a pleasant feeling for the use during rubbing.

Although bottom portion 1 can serve, at least partially, as the bottom of the showerhead, a Carrier portion 8 may be provided on the bottom of the showerhead to protect the relatively sensitive elastic material of bottom portion 1.

Carrier portion 8 is provided with a plurality of openings 9. Bottom portion 1 abuts carrier portion 8 on external side 4 thereof such that respective water passage openings 2 are located in the area of openings 9. Of course, projection 3 is routed through opening 9 and projects beyond external side 10 of carrier portion 8.

In the embodiments of FIGS. 6 through 13 on external side 4 of bottom portion 1 there are pegs 11, each peg 11 projecting into opening 9 of carrier portion 8. At least one water passage opening 2 is routed through each peg 11. Here only projection 3 which abuts peg 11, but not peg 11 itself, extends beyond external side 10 of carrier portion 8. Peg 11 does not project beyond external side 10, as shown in FIG. 6, but may abut it as shown in FIG. 7. However this need not necessarily be so.

At this point, reference should be made to the following to clarify the difference between projection 3 and peg 11. Peg 11 projects beyond bottom portion 1, but not over carrier portion 8 and has at least one water passage opening 2. Projection 3 on the other hand projects beyond bottom portion 1 and carrier portion 8 and does not have water passage opening 2, but instead may include recess 5 and/or notch 6.

The individual embodiments of FIGS. 1 through 13 and their individual differences are briefly detailed below. In FIGS. 1 through 3 bottom portion 1 has no peg. Bottom portion 1 is provided simply with projections 3 with a width or diameter which is less than the width or the diameter of opening 9 of carrier portion 8. In the embodiment of FIGS. 1 through 3 on the periphery of relatively thick projection 3 in the embodiment shown there are two opposite recesses 5 which pass into water passage openings 2 in bottom portion 1. In the embodiment according to FIG. 4 two water passage openings 2 are assigned to one projection 3, while in the embodiment according to FIG. 5 several, preferably four to eight projections 3, are assigned to one water passage opening 2. Of course, more than two water passage openings 2 can also be provided per opening 9 or projection 3.

In the embodiment of FIG. 4, projection 3 is located roughly in the middle of opening 9 and corresponds to at least two water passage openings 2. In the embodiment of FIG. 5, several relatively narrow rib-shaped projections 3 are assigned to water passage opening 2. Preferably, the rib-shaped projections 3 are positioned around the periphery of water passage opening 2.

In the embodiments of FIGS. 6 through 13 there is peg 11 in each. The length of pin 11 is in no case greater than the thickness of carrier portion 8 so that pin 11 does not project beyond carrier portion 8. In the embodiment according to FIG. 6, peg 11 is offset into opening 9, its height is thus less than the thickness of carrier portion 8, while peg 11 in the embodiment according to FIG. 7 is flush with external side 10 of carrier portion 8.

Figure 9:
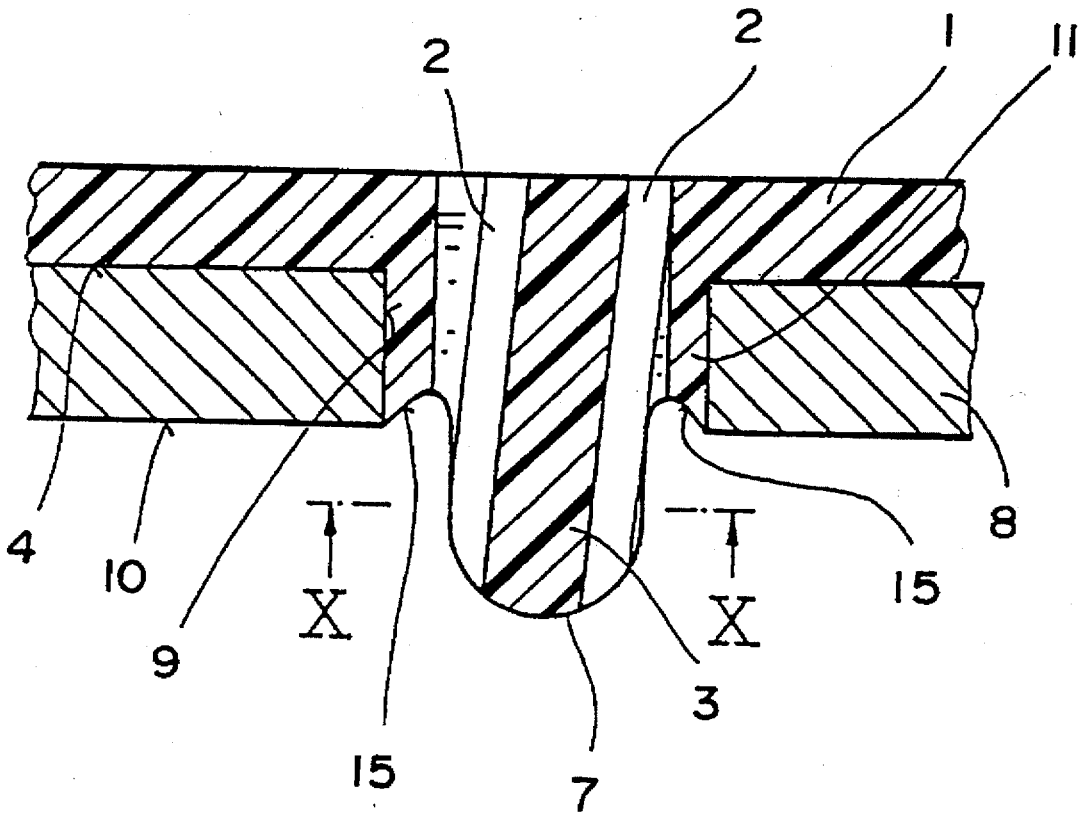
Figure 10:
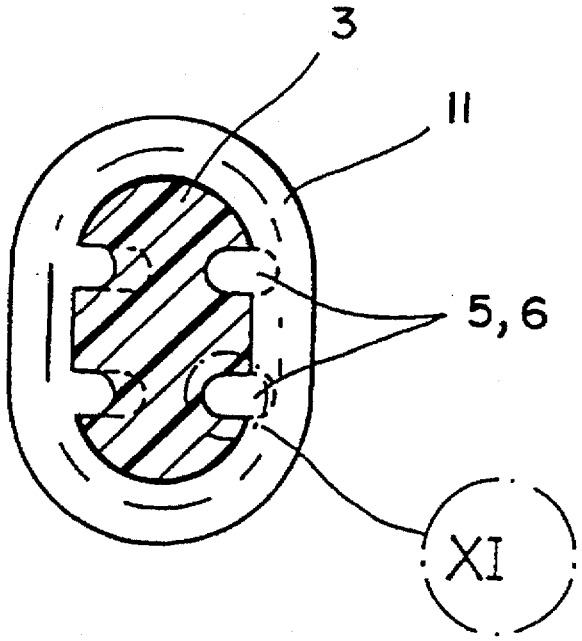
FIG. 10 shows one view along traverse X—X from FIG. 9.

In the embodiments of FIGS. 8 and 9, peg 11 on its external side, at least in the area of the water passage opening, includes bevel 15 inclined to the inside toward water passage opening 2. By means of bevel 15, which is inclined to the inside, not only can projection 3 move back and forth more easily, but also lime deposits which occur at this point can be especially easily removed.

The embodiments of FIGS. 8 through 9 differ in that recesses 5 or notches 6 in the embodiment according to FIG. 9 have an incline which deviates from the vertical, while this is not the case in the embodiment according to FIG. 8. As is apparent from FIG. 10, projection 3 as well as peg 11 has a roughly oval shape. In peg 11 there are four water passage openings 2 which have roughly the same distance from one another.

FIG. 12 shows an embodiment in which projection 3 is directly adjacent to water passage opening 2, but has no recesses 5 or notches 6. With respect to the height and formation of peg 11 the corresponding details to the embodiments of FIGS. 6 through 9 apply. Instead of the oval shape of projection 3 and peg 11 shown in FIG. 10, the shape of wagon wheel 16 can also be selected, as shown in FIG. 13. Water passage openings 2 then have the shape of ring sections which are separated from one another via struts 17. This configuration is recommended for high water pressures.

Figure 14:
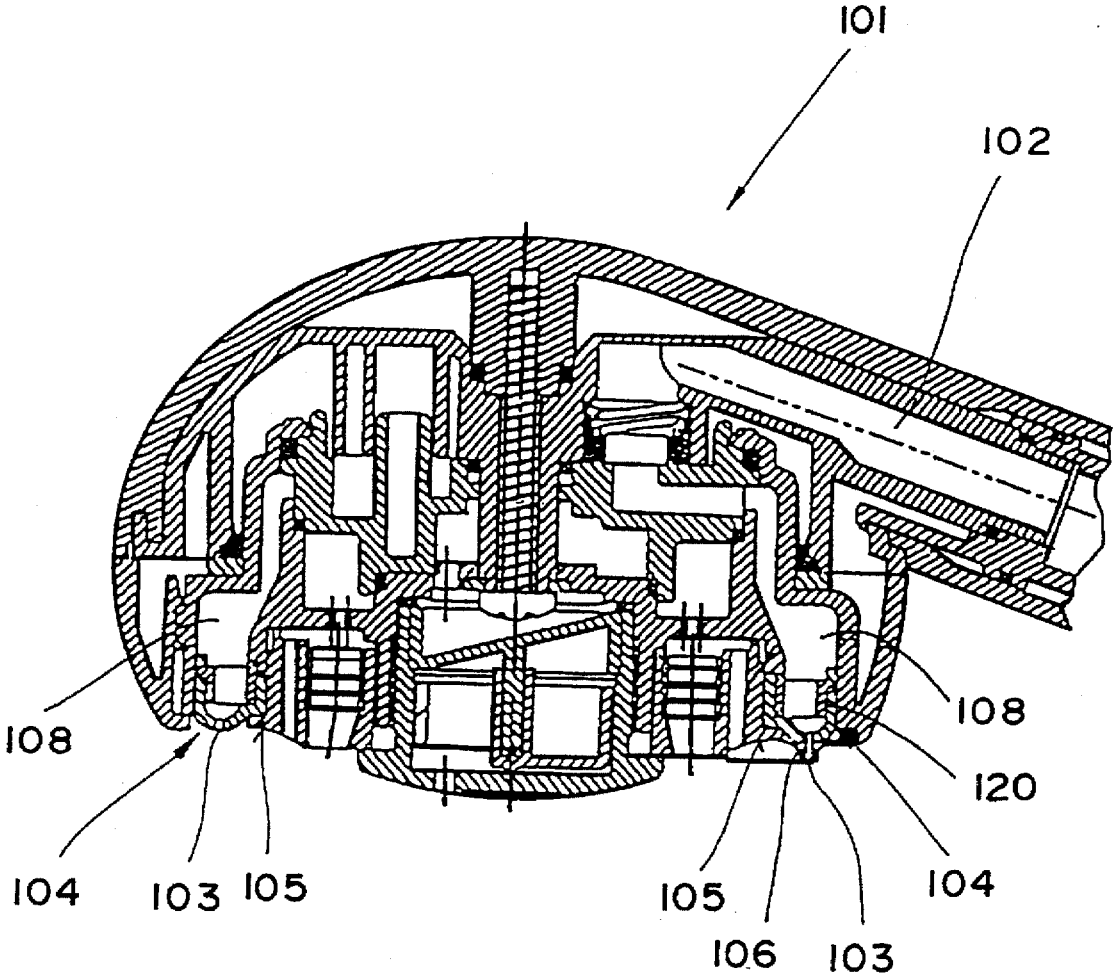
FIG. 14 shows a cross sectional view of a showerhead according to the invention in which two different embodiments are shown.

In FIG. 14 showerhead 101 according to the invention is shown in a cross sectional view. Showerhead 101 with a basically known structure has water supply 102. Furthermore, showerhead 101 is provided with bottom portion 104 which has water passage openings 103. Bottom portion 104 consists of elastic material, preferably with a material hardness from 20 to 120 shore. Water passage openings 103 emerge on external side 105 of showerhead 101. Moreover, at least in the right hand side of the embodiment shown in FIG. 14, water passage openings 103 project beyond external side 105 of showerhead 101. In the left-hand side of the embodiment shown in FIG. 14, water passage openings 103, if at all, project only slightly beyond external side 105 of showerhead 101. Bottom portion 104 is integrally held in showerhead 101 and is connected to water supply 102.

It is significant that bottom portion 104 has at least one roughly annular projection 106, which projects beyond external side 105 of showerhead 101, water passage openings 103 being distributed over the length of projection 106. Projection 106 inherently has at least one ring segment which extends peripherally at least over portion of external side 105 of showerhead 101. Preferably, projection 106, however, has the shape of a closed ring which is located peripherally on external side 105 of showerhead 101. Of course, projection 106 can have the shape as an opened ring.

The annular projection which inherently consists of solid material and which is penetrated only at a few sites by water passage openings can be easily manually deformed by "rubbing" due to the material properties of bottom portion 104, water passage openings 103 also changing their shape. This results in the deposited lime being loosened and removed. Water passage openings 103 each emerge at the outermost extent of projection 106, therefore they are surrounded at least in the peripheral direction by comparatively very elastic material of bottom portion 104 so that there is no need to fear breaking or damage of the projection during "rubbing".

Figure 15:
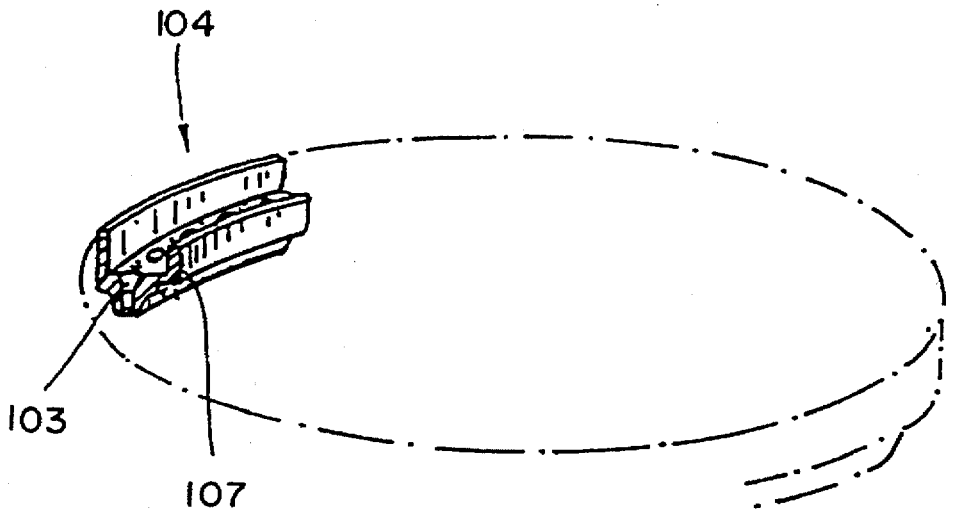
FIG. 15 shows a perspective cross sectional view of a bottom portion according to the invention shown only partially.
Figure 19:
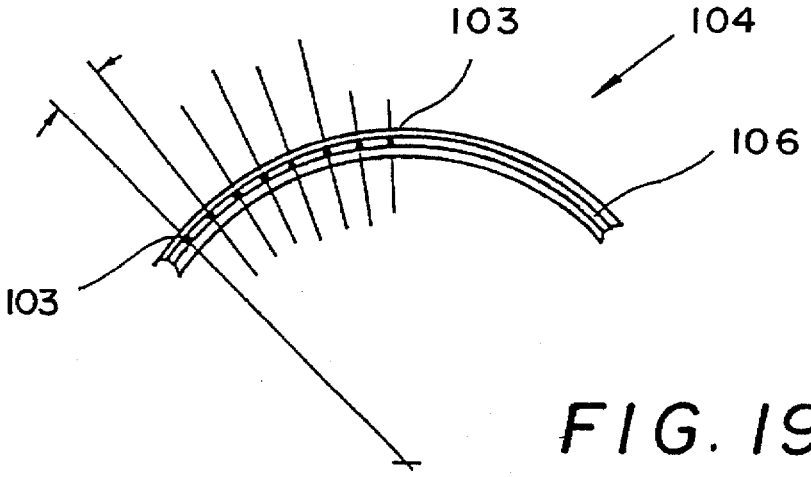
FIG. 19 shows a schematic view of the jet picture of a showerhead according to the invention.

In order to ensure good water distribution by showerhead 101, it is desirable to uniformly distribute water passage openings 103 over the periphery of projection 106. Here it has been ascertained that it is sufficient for a good jet result if the individual water passage openings 103 are spaced by an angle of arc of 6°, as shown in FIGS. 15 and 19, for example. In this way 60 water passage openings 103 are obtained. Moreover, as a result of the advantages of the present invention, flow is assured to take place through all 60 water passage openings after occasional rubbing.

As is apparent especially from FIG. 15, not only is projection 106 made annular, but also bottom portion 104. It is therefore not unconditionally necessary, but fundamentally necessary that bottom portion 104 extends over the entire area of external side 105 of showerhead 101. Annular bottom portion 104 also makes it possible to shift the actual shower function into the region of the outer periphery of showerhead 101, while the center area is available for other possible functions of showerhead 101.

Figure 16:
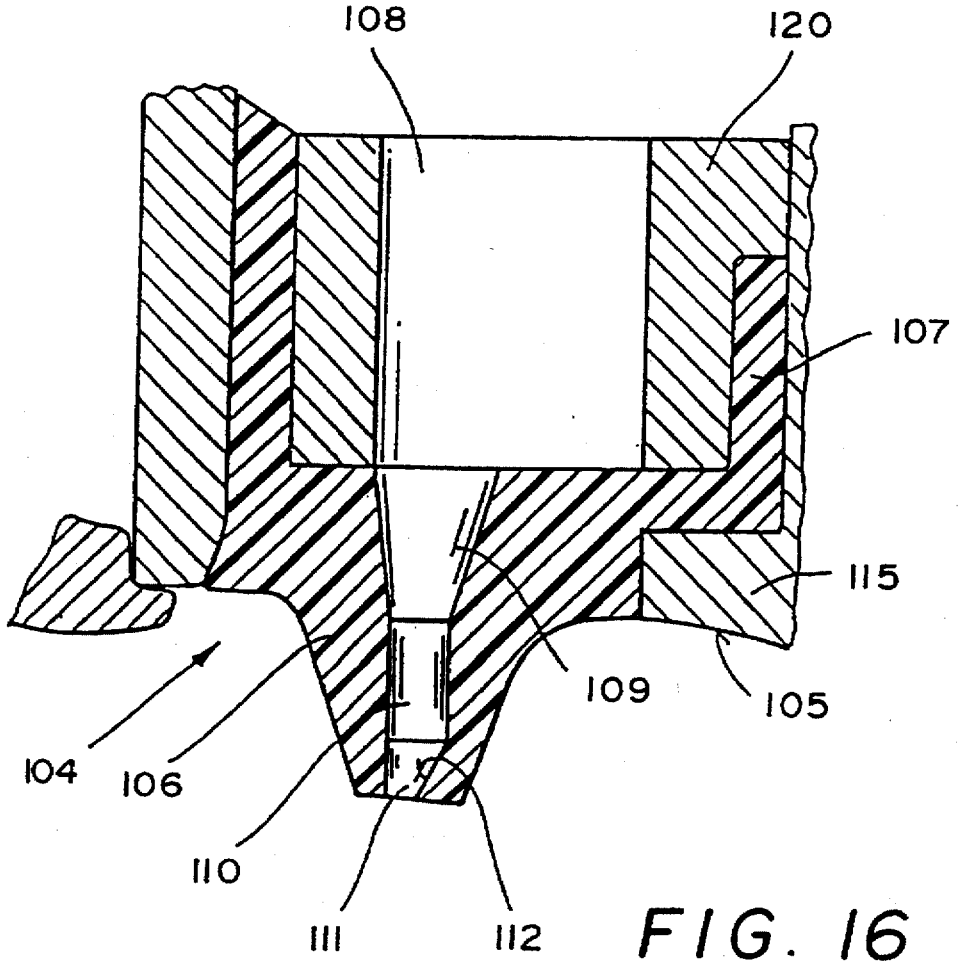
FIG. 16 shows a cross sectional view of one portion of showerhead according to the invention.

As is apparent especially in FIG. 14 through 16, 23 and 24 as well as 27 and 28, bottom portion 104 has area 107 which is made roughly U-shaped in cross section, to which projection 106 is adjacent in the embodiments of FIG. 14 (right-hand drawing) and FIGS. 15 and 16. The U-shape of area 107 allows bottom portion 104 to be held especially easily in annular channel 108 which is provided in the housing of showerhead 101, which is detailed below. Bottom portion 104 is inserted into lower carrier element 115 of showerhead 101 and may be fixed therein by corresponding support means 120. In addition, projection 106, as a result of U-shaped area 107, can be easily pressed into showerhead 101. This further facilitates detachment of lime. Of course, bottom portion 104 can however also be made as a ring disk to which projection 106 is adjacent toward the bottom. Instead of lateral clamping over the U-shaped area, bottom portion 104 can then be held or clamped in the corresponding manner in the housing of showerhead 101. It is advantageous if projection 106 can not only move back and forth, but can also be pressed into showerhead 101.

Figure 17:
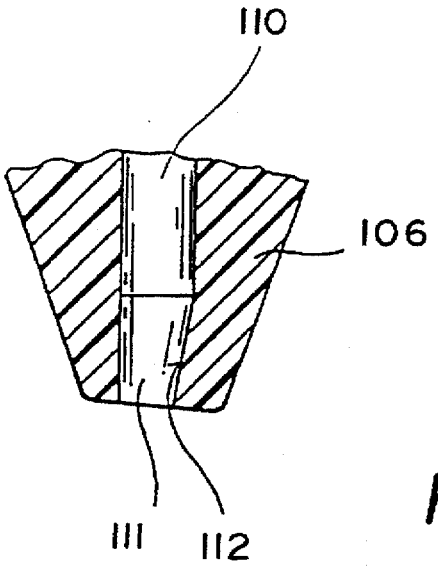
FIG. 17 shows a cross sectional view of one portion of the bottom portion with a water passage opening.
Figure 18:
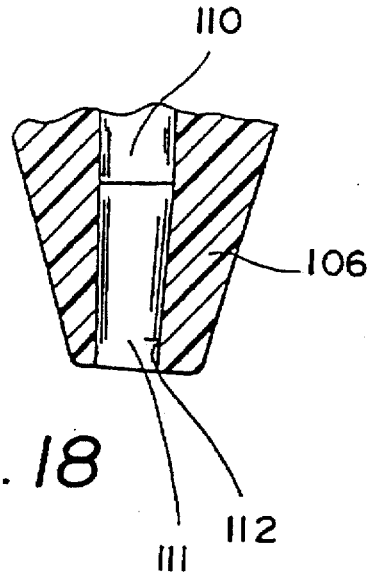
FIG. 18 shows a cross sectional view of another portion of the bottom portion according to the invention with another water passage opening.

Water passage openings 103 have section 109 which tapers in the flow direction. This tapering section 109 acts in the manner of a Venturi nozzle, therefore leading to acceleration of the water. The advantage of this tapering section 109 is that even with a small amount of water a rather powerful water jet can be produced. Tapering section 109 is immediately adjacent to U-shaped area 107. Exit section 110 in turn is directly adjacent to tapering section 109. In its end area 111 exit section 110 is bevelled according to the desired water exit direction. In this case comparison of FIGS. 16, 17 and 18 shows that exit section 110 in its end area 111 can also be made differently with different water passage openings.

To obtain a good jet picture of showerhead 101, it is preferably provided that adjacent water passage openings 103 have different water jet directions. This is achieved via corresponding bevels 112 in end area 111 of respective water passage openings 103. It has been established in tests that good jet results are obtained if the water jet direction of individual water passage openings 103 is between 0° and 16°. In one especially preferred embodiment, the jet picture repeats periodically with water jet directions of individual water passage openings 103 of 8°, 5°, 8°, 5°, 8° and 2° (compare FIG. 19). At an arc distance of 6° from water passage opening to water passage opening, this jet picture occurs ten times in projection 106 so that there are thirty water passage openings 103 with a slope of 8° against the vertical, twenty water passage openings 103 with a slope of 5°, and ten water passage openings 103 with a slope of 2°.

In the embodiment shown, end area 111 shown in FIG. 16 has bevel 112 with an angle of 16° so that a water jet direction of 8° arises. In FIG. 17 bevel 112 in end area 111 has an angle of 10° so that here the water jet direction is 5°. Finally, in the embodiment shown in FIG. 18, bevel 112 is sloped at an angle of 4° against the vertical, so that the water jet direction is 2°. Tapering section 109 is the same for each individual water passage opening 103. Depending on the desired water jet direction, exit section 110 for the individual water passage openings is made differently. Consequently, end area 111 is longer or shorter depending upon the angle provided by exit section 110.

Figure 20:
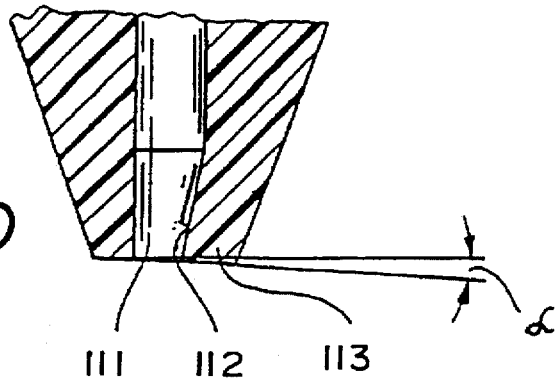
FIG. 20 shows a cross sectional view of one portion of the bottom portion.

Based on the different shaping of exit sections 110 or individual end areas 111, different flow resistances can arise. Water passage openings 103 are however made such that regardless of the water jet direction the same flow rate arises. This is accomplished by the fact that the lower surface of water passage openings 103 in the area of the exit is bevelled at a small angle $\alpha$ from 0° to 1° degree according to the desired requirements, as shown in FIG. 20. In the area of bevel 112 adjacent to end area 111, this yields projection 113 by which the water passage opening is tapered.

Figure 21:
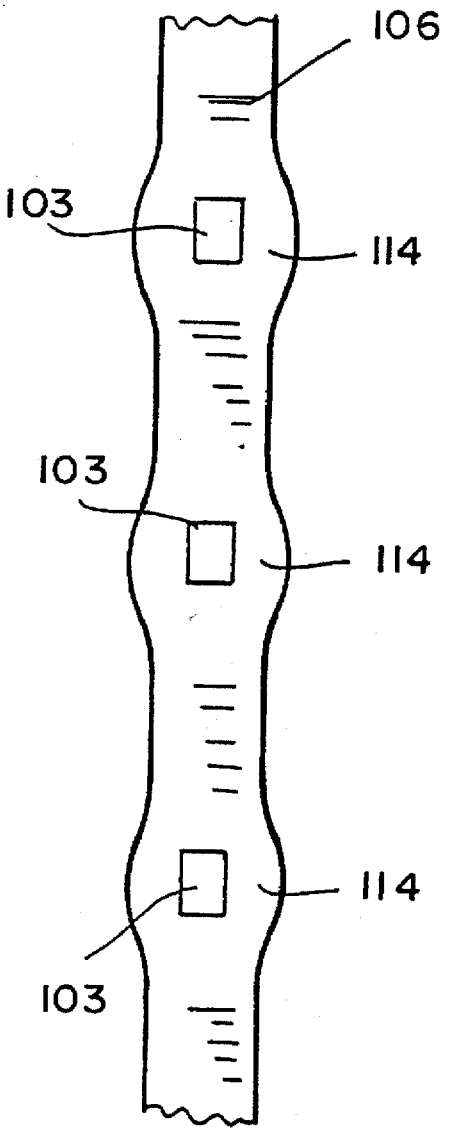
FIG. 21 shows a stretched view of an annular projection of the bottom portion according to the invention.
Figure 22:
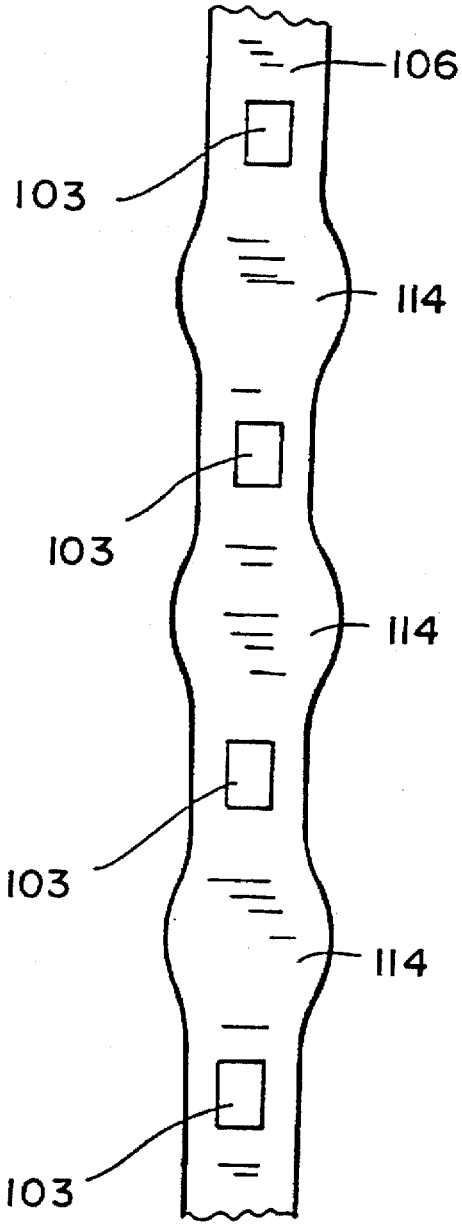
FIG. 22 shows another stretched view of another embodiment of the bottom portion according to the invention.
Figure 23:
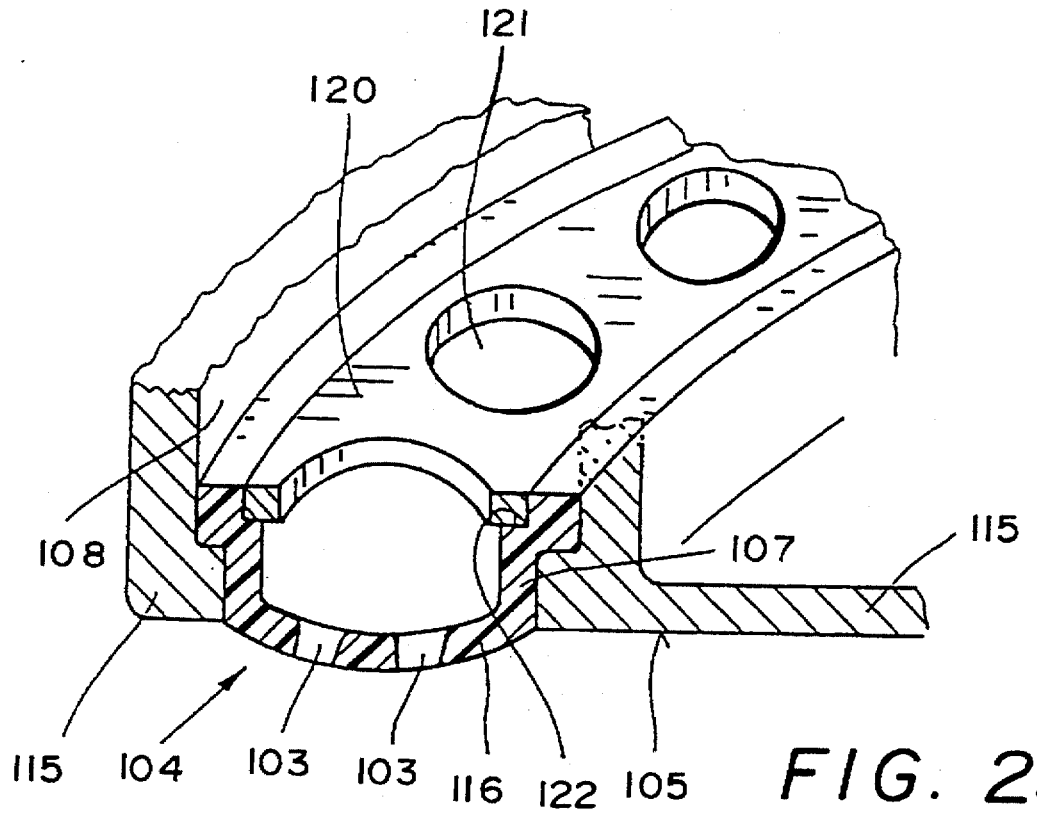
FIG. 23 shows a perspective cross sectional view of one portion of another embodiment of the showerhead according to the invention.
Figure 24:
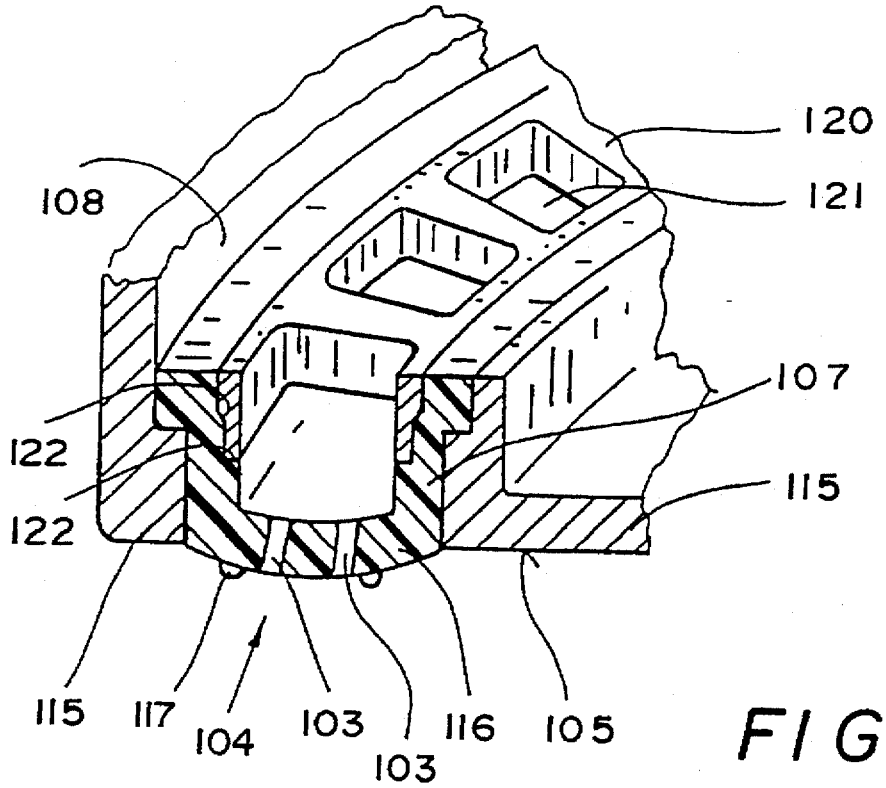
FIG. 24 shows a view of another embodiment of the showerhead according to the invention shown in FIG. 22.

As follows especially from FIGS. 21, 22 and 26, inside and/or outside of projection 106 and/or bottom portion 104 there is at least one bulge 114. Bulges 114 not only have an aesthetic effect, when the lime is stripped they impart the impression of "rubbing", but also serve to prevent displacement of annular bottom portion 104 within showerhead 101. Moreover, it follows from FIGS. 21 and 22 that water passage openings 103 have a rectangular form at least on their outlet-side end.

In FIGS. 23 to 26 other embodiments of showerhead 101 according to the invention are shown. In the embodiment shown in FIGS. 23 and 24 bottom portion 104 is inserted into lower carrier element 115 of showerhead 101 and is fixed therein. It is important that bottom portion 104 has section 116 which is made as a membrane. In this section 116, there are water passage openings 103. Water passage openings 103 can be aligned as described above. Formation as a membrane makes it possible to deform the membrane when correspondingly little pressure is applied to section 116, which leads to detachment of the lime which has been deposited there.

For the aforementioned reasons of simple attachment, bottom portion 104 has area 107 which is roughly U-shaped in cross section. Section 116 is thus between the two side arms of U-shaped area 107. Also in the embodiments of FIGS. 23 and 24, bottom portion 104 is formed in turn as a ring which has the aforementioned advantages. In both embodiments section 116 projects beyond external side 105 of showerhead 101. In these embodiments "rubbing" can be done especially easily by simply rubbing gently over external side 105 of showerhead 101 and in doing so impressing section 116. This is especially possible when section 116 and external side 105 pass continuously into one another. This can also prevent U-shaped area 107 or bottom portion 104 from being unintentionally damaged.

It is advantageous if section 116 of the area can be made concave or flat. In the concave, therefore inwardly curved, or flat shaping of section 116 it can be moved by water flowing through the showerhead and by the flow pressure acting on the inside of section 116 so that it curves outward. If at this point the water pressure changes, as a result of the membrane properties of section 116 a corresponding movement occurs which likewise leads to lime detachment. In any case, however, to facilitate additional "rubbing", at least one knob 117 can be provided on the outside of section 116 which projects beyond external side 105 of showerhead 101.

Figure 25:
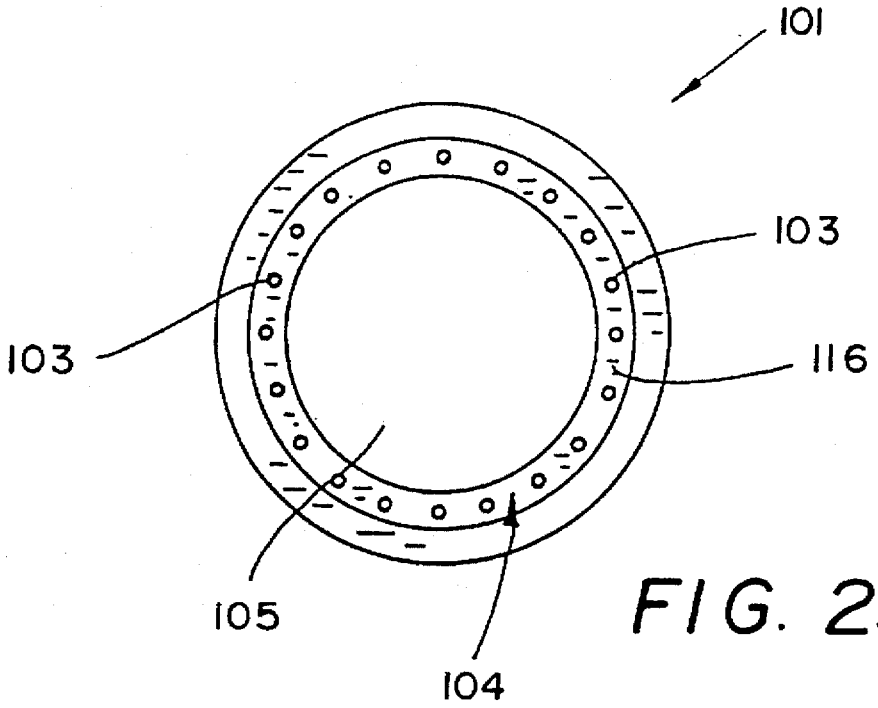
FIG. 25 shows a bottom view of a showerhead according to the invention.
Figure 26:
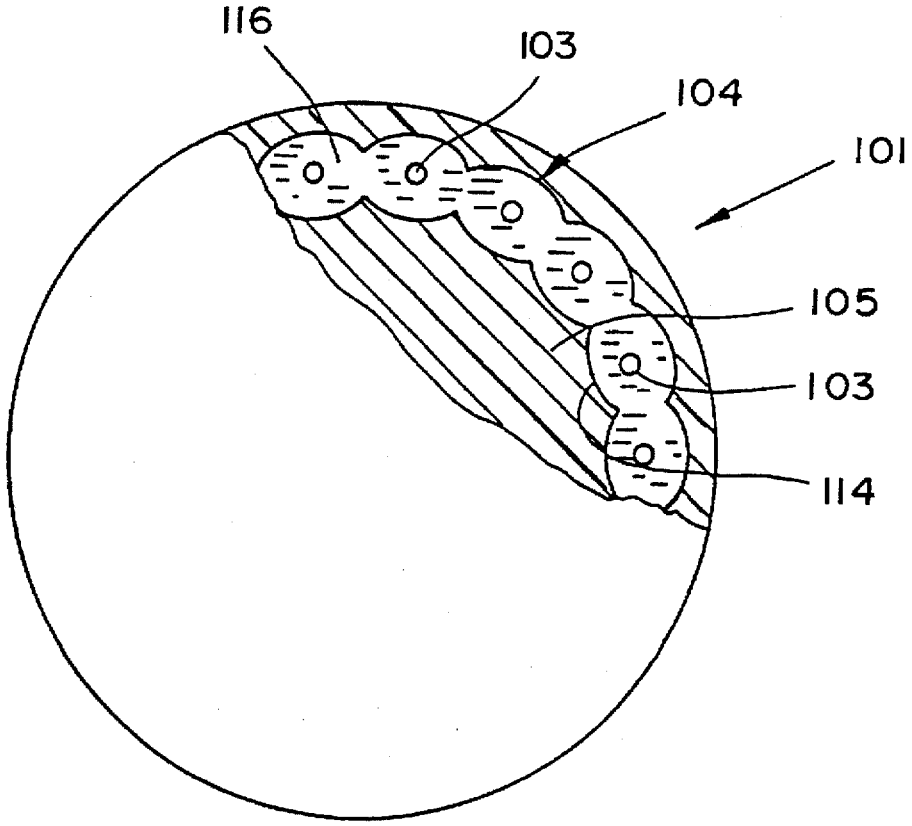
FIG. 26 shows another bottom view of another embodiment of the showerhead according to the invention.
Figure 27:
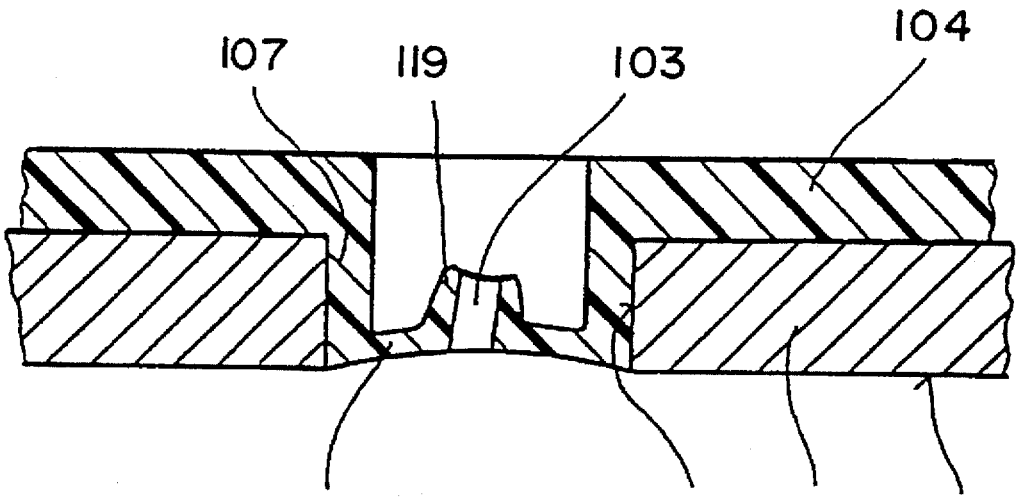
FIG. 27 shows a cross sectional view of another embodiment of the showerhead according to the invention and FIG. 28 shows a cross sectional view of another embodiment of the showerhead according to the invention.
Figure 28:
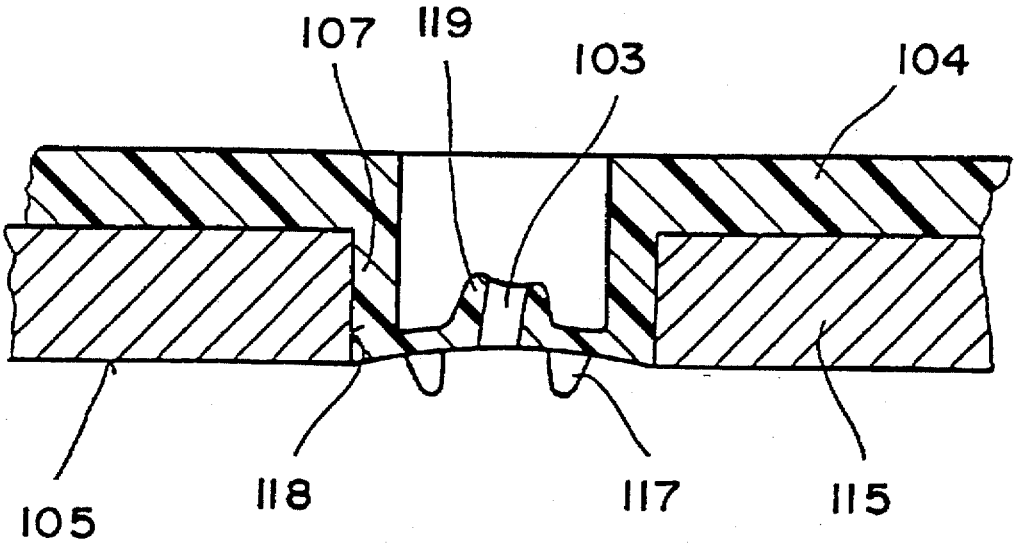

While the annular shaping of bottom portion 104 is readily apparent from FIGS. 25 and 26, in FIGS. 27 and 28 another embodiment is shown in which basically likewise section 116 is made as a membrane. For the embodiments shown in FIGS. 27 and 28 the aforementioned still applies, with the exception that bottom portion 104 is not made as a ring, but has a plurality of sections 116 which are distributed roughly over entire external side 105 of the showerhead. In carrier element 115 there are a plurality of openings 118 into which corresponding U-shaped areas 107 project. As a result of the U-shape, the areas are two-dimensional and designed such that a user can impress sections 116.

In order to prevent exposure of water passage openings 103 which are provided in individual areas 107 from being accidentally damaged by manual pressure from outside and/or the water pressure and the associated movement of section 116, there is collar 119 which projects into the interior of area 107 in prolongation of water passage openings 103. Collar 119 therefore represents reinforcement for water passage opening 103 to the inside.

In order to fix annular bottom portions 104 in showerhead 101 and to keep them open in the U-shape, there is corresponding support means 120. Support means 120 has preferably a peripheral support ring which is provided with a plurality of passage openings 121, as follows especially from FIGS. 23 and 24. Support means 120 clamps bottom portion 104 in ring channel 108 of showerhead 101. As follows from FIGS. 23 and 24, corresponding steps 122 can be provided in U-shaped area 107 for insertion of support means 120.

We claim:

1. A bottom portion for a showerhead, said bottom portion comprising an elastic material and including at least one water passage opening and at least one projection joined to said bottom portion, said at least one projection extending beyond an outermost surface of said bottom portion and aligned with at least one water passage opening, wherein said at least one projection corresponds to at least one water passage opening such that an outer surface of said projection extends continuously through an inner surface of said water passage opening.

2. The bottom portion according to claim 1, wherein said at least one projection is made integral with said bottom portion and comprises said elastic material of said bottom portion and wherein said at least one projection includes at least one recess extending along said at least one projection through said inner surface of said water passage opening.

3. The bottom portion according to claim 2, wherein said recess is a notch.

4. The bottom portion according to claim 2, wherein said at least one projection is sloped at said at least one recess against the vertical.

5. The bottom portion according to claim 4, wherein said at least one projection includes an outer rounded end.

6. A showerhead comprising a bottom portion, said bottom portion comprising an elastic material and including at least one water passage opening and at least one projection joined to said bottom portion, said at least one projection extending beyond an outermost surface of said bottom portion and aligned with at least one water passage opening, wherein said at least one projection corresponds to at least one water passage opening such that an outer surface of said projection extends continuously through an inner surface of said water passage opening.

7. The showerhead of claim 6, further comprising a carrier portion on an outermost surface of said bottom portion, wherein said carrier portion includes at least one opening such that said at least one water passage opening is aligned with said at least one opening and wherein said at least one projection extends through said at least one opening beyond an outermost surface of said carrier portion.

8. The showerhead according to claim 7, wherein said outermost surface of said bottom portion includes a plurality of pegs which each project into said at least one opening of said carrier portion, said water passage opening being located through said plurality of pegs, wherein said plurality of pegs are contained entirely within said openings of said carrier portion.

9. The showerhead of claim 8, wherein each of said plurality of pegs includes a bevel at an end thereof which is angled inwardly away from said outermost surface of said carrier portion toward said water passage opening.

10. A showerhead with a bottom portion of elastic material including a plurality of water passage openings extending therethrough and emerging from an outermost surface of the showerhead, said bottom portion comprising at least one annular extending projection member located along a periphery of the showerhead, wherein an annular portion of said projection member extends beyond the outermost surface of the showerhead and said plurality of water passage openings are distributed over the annular portion of said projection member.

11. The showerhead according to claim 10, wherein said projection member includes a least one ring segment.

12. The showerhead according to claim 11, wherein said projection member is a closed ring.

13. The showerhead according to claim 10, wherein said plurality of water passage openings each emerge at an outermost point of said projection member away from said showerhead.

14. The showerhead according to claim 13, wherein said plurality of water passage openings are uniformly distributed over the periphery of said projection member.

15. The showerhead according to claim 14, wherein said plurality of water passage openings are spaced by an angle of arc of 6°.

16. The showerhead according to claim 11, wherein said bottom portion further includes a U-shaped section adjacent said projection member for engaging a portion of said showerhead to hold said projection member in place.

17. The showerhead according to claim 10, wherein each of said plurality of water passage openings include a first tapered section therein which tapers inwardly in a direction of exiting water flow through said projection member.

18. The showerhead according to claim 17, wherein each of said plurality of water passage openings further includes an exit section adjacent said first section and downstream thereof and a second tapered section downstream of said exit section which tapers inwardly in the direction of exiting water flow through said projection member.

19. The showerhead according to claim 18, wherein each of said plurality of water passages provides a different water jet direction from an adjacent water passage.

20. The showerhead according to claim 19, wherein said water jet direction is between 0° and 16° to the vertical.

21. The showerhead according to claim 20, wherein said plurality of water passages are positioned to provide a periodically repeating set of water jet directions of 8°, 5°, 8°, 5°, 8° and 2°.

22. The showerhead according to claim 20, wherein each of said water passage openings are shaped to provide a common exiting water flow rate independent of said water jet direction.

23. The showerhead according to claim 10, wherein at least one of said bottom portion and said projection member includes at least one lateral bulge for preventing displacement of said bottom portion within said showerhead, said at least one lateral bulge being located on at least one of an inside and outside of said bottom portion and said projection member, respectively.

24. A showerhead with a bottom portion of elastic material including a plurality of water passage openings extending therethrough and emerging from an outermost surface of the showerhead, said bottom portion comprising at least one annular extending member located along a periphery of the showerhead; wherein said annular extending member comprises a membrane which is accessible from the outermost surface of the showerhead and includes said water passage openings.

25. The showerhead according to claim 24, wherein said bottom portion includes a U-shaped section for engaging a portion of said showerhead to hold said extending member in place and a water passage section comprising said membrane.

26. The showerhead according to claim 25, wherein water passage section is annular in shape and extends peripherally along the outermost surface of the showerhead.

27. The showerhead according to claim 26, wherein said water passage section is a closed ring.

28. The showerhead according to claim 26, wherein said water passage section comprises a plurality of sections which are distributed peripherally along the outermost surface of the showerhead.

29. The showerhead according to claim 25, wherein said water passage section projects beyond said outermost surface of the showerhead.

30. The showerhead according to claim 29, wherein said water passage section is made convex.

31. The showerhead according to claim 29, wherein said water passage section is made concave.

32. The showerhead according to claim 29, wherein said water passage section is made flat.

33. The showerhead according to claim 29, wherein said water passage section and said outermost surface of said showerhead pass continuously into one another.

34. The showerhead according to claim 25, wherein said water passage section includes at least one knob provided on the outside thereof which extends beyond the outermost surface of the showerhead.

35. The showerhead according to claim 34, wherein at least one water passage opening includes a collar which extends from said water passage opening into said water passage section.

36. The showerhead according to claim 25, further including a support means for engaging said U-shaped area.

37. The showerhead according to claim 36, wherein said support means comprises a support ring including a plurality of passage openings therein.

* * * * *